United States Patent [19]

Grisel

[11] Patent Number: 5,014,399

[45] Date of Patent: May 14, 1991

[54] SHEET FASTENING ASSEMBLY AND FASTENER THEREFOR

[75] Inventor: Joseph P. Grisel, Tulsa, Okla.

[73] Assignee: Blue Magic Products, Inc., Stockton, Calif.

[21] Appl. No.: 391,045

[22] Filed: Aug. 9, 1989

[51] Int. Cl.[5] ..... A47C 21/00

[52] U.S. Cl. ..... 24/72.5; 24/490; 5/508

[58] Field of Search ..... 24/74.2, 72.7, 490, 24/462; 5/498, 508

[56] References Cited

U.S. PATENT DOCUMENTS

| | | | |
|---|---|---|---|
| 385,237 | 6/1888 | Bright | 24/490 |
| 413,772 | 10/1889 | Arnold . | |
| 498,527 | 5/1893 | Willard | 24/490 |
| 557,456 | 3/1896 | Utter | 24/72.5 |
| 811,638 | 2/1906 | Hoffman . | |
| 1,487,387 | 3/1924 | Hurlbutt | 24/72.7 |
| 1,602,305 | 10/1926 | Helm | 24/72.5 |
| 1,792,128 | 2/1931 | Stevenson | 24/72.7 |
| 2,641,039 | 6/1953 | Bissell | 24/490 |
| 3,406,434 | 10/1968 | Moskowitz | 24/490 |
| 4,782,543 | 11/1988 | Hutton et al. | 5/508 |

FOREIGN PATENT DOCUMENTS

| | | | |
|---|---|---|---|
| 0270521 | 11/1950 | Switzerland | 24/490 |

*Primary Examiner*—Victor N. Sakran

*Attorney, Agent, or Firm*—Vorys, Sater, Seymour & Pease

[57] ABSTRACT

A sheet fastening assembly is disclosed for releasably securing sheets to an object. Included in the assembly is an anchoring device, an interconnecting device and a sheet fastener. The sheet fastener includes a sheet grasping member which is slidable within a slot defined by a clasping member of the fastener for releasably securing sheet material therebetween. The slidable sheet grasping member is provided with locking tabs for releasably locking the slidable member in a sheet engaging position.

2 Claims, 2 Drawing Sheets

SHEET FASTENING ASSEMBLY AND FASTENER THEREFOR

BACKGROUND OF THE INVENTION

The present invention relates generally to a sheet fastening assembly for releasably securing sheet material to an appropriate structure as well as to an improved fastener therefor.

It is desirable to retain bedsheets tightly fitted whether on conventional mattresses or waterbed mattresses. Waterbed mattresses are quite popular, but such mattresses are heavier than regular mattresses and this factor can be an obstacle for some people when fitting the bedsheets. Therefore, there is a desire to be able to easily attach and remove bedsheets from a waterbed mattress without the necessity of lifting corners of the mattress. There is also a desire to allow a user to easily fit bedsheets having a wide variety of sizes on such mattresses. Furthermore, it is desirable to be able to firmly and lockably grasp the bedsheets so as to retain them in a taut and fitted condition.

Numerous devices exist which secure sheet material to an object. For instance, a number of different types of fastening devices have been used for tent tie-downs, tie-downs used in the construction industry for canvas and plastic tarpaulins, as well as fasteners for garments. Examples of fasteners of the latter type are described generally in U.S. Pat. Nos.: 413,772; 498,527; 811,638 and 3,406,434. It is desired to improve upon the manner by which fasteners of the foregoing type engage and release fabrics.

SUMMARY OF THE INVENTION

According to the present invention there is provided a sheet fastening assembly for fastening sheet material to a variety of objects. More specifically, the present invention satisfies the foregoing described needs in connection with securing bedsheets to mattresses, especially of the waterbed type. Included in the fastening assembly is an anchoring means for facilitating releasable anchoring of the fastening assembly to a variety of objects. Provision is made for fastening means for releasably securing the sheet material thereto. The fastening assembly includes interconnecting means for interconnecting the fastening means to the anchoring means.

In an illustrated embodiment there is provided a bedsheet fastening assembly which includes an anchoring means for anchoring the fastening assembly to and between a mattress and a bedframe. Included is bedsheet fastening means for releasably grasping and retaining the bedsheet thereto. The fastening means includes a clasping member having a bedsheet receiving slot therein and a slidable sheet grasping member movably mounted on the clasping member. The sheet grasping member includes projection means which includes a neck portion and a relatively enlarged button portion extending from the neck portion. The neck portion is slidable within and guided by wall portions defining the slot and is sized so that the sheet can be fitted over the button and move in the slot as the sheet grasping member slides. Thus, the bedsheet is firmly and releasably grasped between the slidable member and the walls defining the slot. The sheet grasping member is also mounted to be tiltably and slidably moveable relative to the clasping member for facilitating attachment and detachment of the bedsheet. In this regard, the projecting means will travel between a position adjacent to a front surface of the clasping member to a position adjacent to a rear surface of the clasping member as the grasping member slidably and tiltably moves between fastening and unfastening conditions.

In another illustrated embodiment the slidable sheet grasping member has a pair of oppositely extending detent or locking tabs which is constructed to engage the bedsheet and releasably hold the latter in complementary shaped slots in the clasping member. In this manner the sheet grasping member can be better retained its desired locking condition. A pair of sliding tabs protrude from lateral edges of the sheet grasping member and are adapted to grasp the bedsheet between them and the bottom surface of the clasping member.

In another illustrated embodiment, the clasping member is provided with recessed areas which are adapted to slidably receive therein the slide tabs for purposes of maintaining a desired orientation of the sheet grasping member.

Among the other objects and features of the present invention are the provision of an improved sheet fastening assembly; the provision of an improved sheet fastener; the provisions of a sheet fastener assembly and sheet fastener which are adapted for securing bedsheets to mattresses; the provision of an improved sheet fastener which includes an improved sheet grasping member that slidably and tiltably moves relative to a sheet clasping member; the provision of a sheet fastener wherein the sheet grasping member thereof has a releasable locking arrangement with a clasping member thereof; and, the provision of a sheet fastening assembly which accommodates different sized bedsheets.

Still other objects and further scope of applicability of the present invention will become apparent from a detailed description to follow when taken in conjunction with the accompanying drawings in which like parts are designated by like reference numerals throughout the several views.

DETAILED DESCRIPTION

Referring now to FIGS. 1-5 there is disclosed a preferred embodiment of the present invention which defines a sheet fastening assembly 10. In this embodiment it is for securing a bedsheet 12 to a mattress 14 and a bedframe 16. While the present embodiment discloses the sheet fastening assembly 10 for use in securing a bedsheet, it is well within the spirit and scope of the present invention to have the sheet fastening assembly releasably secure other forms of sheet materials, such as tarpaulins, tents and the like.

Figure 1:
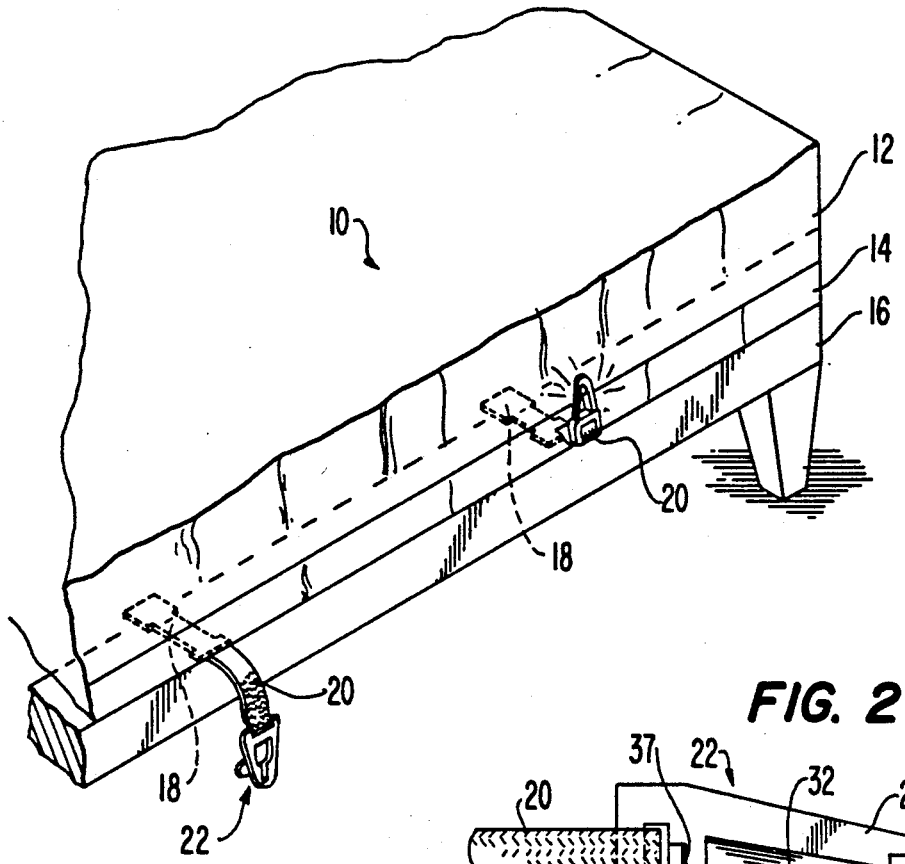
FIG. 1 is a perspective view of one preferred embodiment of the sheet fastening assembly of the present invention.
Figure 3:
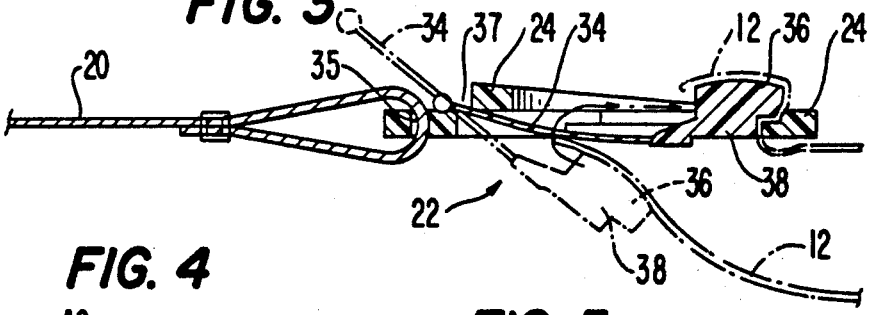
FIG. 3 is a cross-sectional view taken along section line 3—3 of FIG. 2
Figure 4:
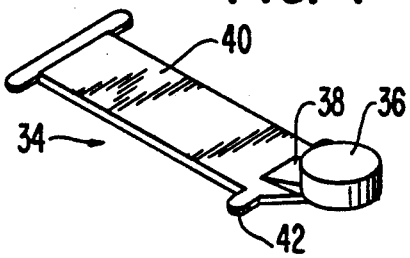
FIG. 4 is a perspective of a component of the sheet fastener of the present invention.
Figure 5:
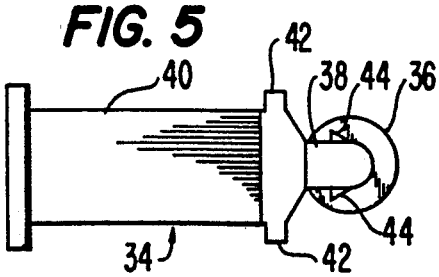
FIG. 5 is a bottom view of the component illustrated in FIG. 4.
Figure 6:
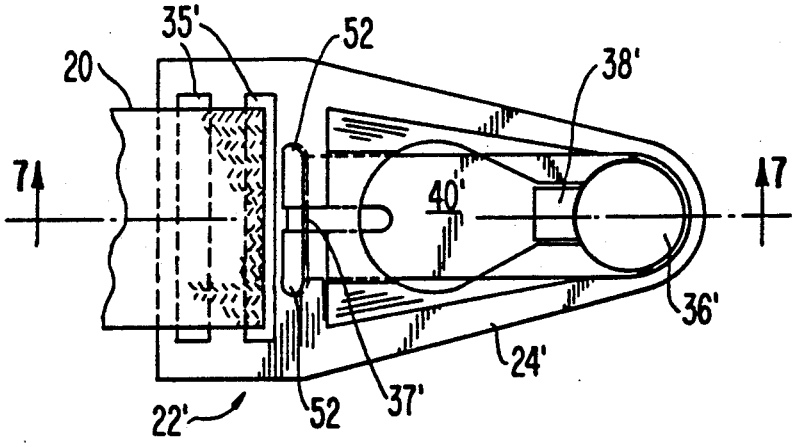
FIG. 6 is a plan view of another preferred embodiment of a sheet fastener of the present invention.
Figure 7:
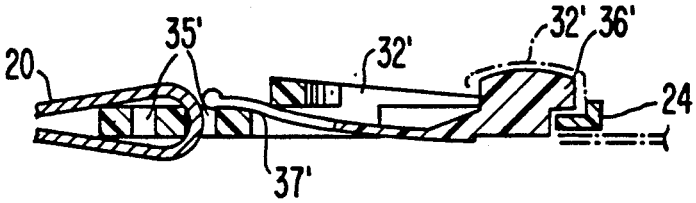
FIG. 7 is a cross-sectional view taken along section line 7—7 of FIG. 6.
Figure 8:
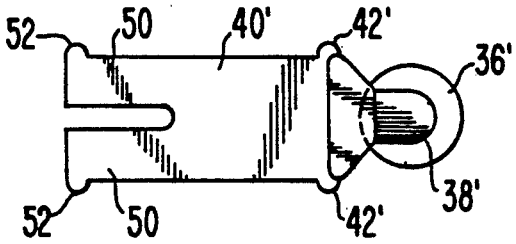
FIG. 8 is a bottom view of a component of a fastener of FIG. 6.
Figure 9:
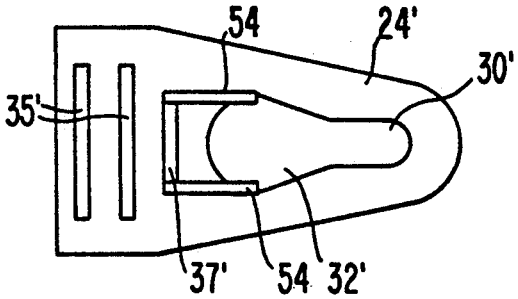
FIG. 9 is a bottom view of another component of the sheet fastener.

As best shown in FIG. 1 the sheet fastening assembly 10 includes an elongated anchoring plate 18 made of a resiliently flexible plastic material which is adapted to be inserted between the underside of the mattress 14 and the bedframe 16. The flexibility allows the anchoring plate 18 to bend in response to pulling or tensioning. Anchoring plates having other configurations and different material can be used. It is contemplated that such anchoring plates can have any kind of arrangement for securing the plate to a supporting object. The sheet fastening assembly 10 also includes an elastic interconnecting band 20 which has one end secured to the anchoring plate 18 while the other end is secured, as shown in FIG. 3, to a buckle device or fastener means 22. The elastic band 20 allows the fitting of different sized bedsheets to the mattress 14.

The fastener 22 includes an elongated clasping member 24 having the configuration as shown and having a key-shaped slot 26 formed centrally therein. Wall portions 28 of the clasping member 24 define a relatively narrow channel portion 30 of the slot 26 and an enlarged circular portion 32 which is sized to receive both the bedsheet 12 and a portion of an elongated and slidable sheet grasping member 34, as will be explained. The clasping member 24 is also formed with a fastening slot 35 to retain a loop of the band 20.

The sheet grasping member 34 is adapted to be slidably and tiltably mounted within a slot 37 on the clasping member 24. The sheet grasping member 34 includes at a forward end thereof, a projection means defined by a button-shaped projection 36 which is integrally connected to an inclined neck portion 38 that extends from a generally flexible and elongated flat body portion 40. The dimension of the neck 38 is narrower than the width of the channel 30 so that the bedsheet can be fit over the button 36 and in the slot. Outwardly extending tabs 42 integral to the body portion 40 extend outwardly in a direction so as to straddle the channel 30 and assist in retaining the sheet grasping member 34 to the clasping member 24. In the present invention, the projection button 36 is generally disc-shaped and is adapted to slide 30 with a piece of the bedsheet 12 fitted thereover. The button 36 is sized to facilitate a user grasping it and a marginal edge of the bedsheet 12 so that the latter can slide in and along the channel 30 for securing the same. The body portion 40 and slide tabs 42 are constructed to be wider than the slot 26 and thereby assist in grasping the bedsheet and also resisting twisting movement of the grasping member 34. The clasping member 24 and the slidable member 34 are, preferably, made of plastic which is slightly yieldable so as to facilitate grasping the material about the button and forcing the grasping member 34 and the bedsheet along the channel 30. Although this embodiment describes both the clasping member 24 and the sheet grasping member 34 as being made of flexible plastic material, it is understood, that these structures can be made from any variety of materials to suit the sheet grasping situation contemplated. The neck 38 extends from the body portion 40 so that the bottom surface of the button 36 can accommodate the bedsheet 12 between it and a top surface of the clasping member 24. Also, the body portion 40 and slide tabs 42 are spaced from the bottom surface of the clasping member 24 to accommodate the bedsheet there between. This insures a snug fit of the sheet grasping member 34 relative to the clasping member.

Figure 2:
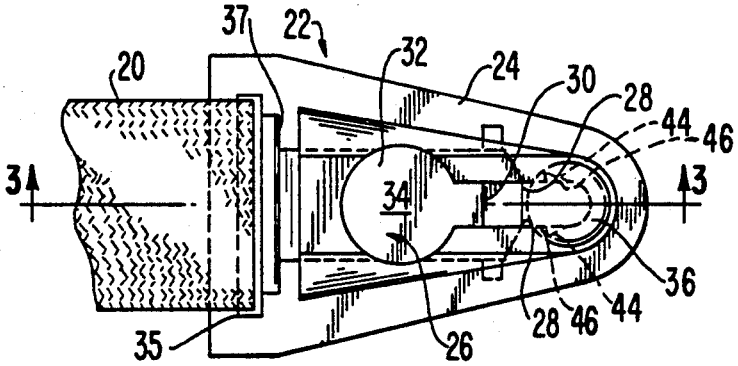
FIG. 2 is a plan view of an enlarged sheet fastener of the present invention.

The present invention also contemplates releasably locking the sheet grasping member 34 when the latter is in the sheet grasping position, such as shown in FIGS. 2 and 3. Towards this end, the present sheet grasping member 34 includes a pair of locking detents or tabs 44 which extends outwardly from the neck portion 38 and is adapted to be releasably received within the complementary formed slots 46 formed in the clasping member 24 adjacent the channel 30. The locking detents or tabs 44 when sliding along the clasping member 24 adjacent the channel 30 will actually engage the bedsheet 12 and can be received within the slots 46. This cooperation assists in retaining the grasping member 34 and the bedsheet 12 in a locked condition. To release the sheet grasping member 34, the tabs 44 are forced from the slots 46. In this connection the slidable member 34 can be displaced by slightly bending it so as to release the locking tabs 44. Accordingly, the sheet grasping member 34 can then be longitudinally displaced so that the button 36 is in registration with the opening 32 to thereby allow release of the bedsheet 12. When the projection button 36 slides rearwardly to the enlarged opening 32, the sheet grasping member 34 can be tiltably or swingably moved relative to the clasping member 24, as shown, to thereby greatly facilitate release of the sheet material. In this connection the button 26 of the grasping member 34 can move between a position adjacent a top surface at the clasping member 24 to one adjacent a bottom surface of the clasping member. Thus, there is less of a tendency for the sheet to impede unfastening than known fasteners of this kind. The grasping member 34 is formed with a retaining rib 48 to keep the former retained on the clasping member 24.

Reference is now made to FIGS. 6–9 which show another embodiment of the fastener device 22' of the present invention. The structure in this embodiment like that of the previous embodiment will be marked with the same reference numerals with, however, the addition of a prime marking. One difference of this embodiment is that the body portion 40' is formed with a pair of split retaining legs 50 each having retaining tabs 52 projecting outwardly therefrom. The split legs 50 facilitate the insertion and removal of the sheet grasping member 34' relative to the clasping member 24'. The tabs 52 facilitate retention of the grasping member 34'. Additionally, the clasping member 24' is formed with inclined slide recesses 54 (FIG. 9) which are adapted to removably and slidably engage opposite ends of the tabs 42'. The tapered recesses 54 facilitate guidance of the grasping slidable member 34' during a portion of the latter's reciprocating movement. The clasping member 24' can have double slots 35' for allowing an end of the band 20 to be secured thereto. Unlike the previous embodiment, this embodiment is not formed with locking detents.

It is believed from the foregoing detailed description of the structure that the operation of the present invention is self-evident. With the present invention, it will be appreciated that the anchoring plate 18 can be maintained between the mattress 14 and the bedframe 16. The fastener 22 can releasably grasp marginal edges of the bedsheet 12 and retain the latter in a desired fitted condition. There is no need for fitting the bedsheets 12 on the bottom of the mattress corners and the nature of the assembly 10 allows it to secure bedsheets of various sizes.

Certain changes may be made in the above described sheet fastening assembly and fastener without departing from the scope of the present invention. For example, the present invention can be used for tent tie-downs, construction tie-downs for canvas and plastic tarpaulins, and a wide variety of other sheet grasping functions. It is intended that the matter contained in the description above and shown in the accompanying drawings shall be interpreted as illustrative and not in a limiting sense.

What is claimed is:

1. A bedsheet fastening assembly comprising:

an anchoring means for anchoring a sheet fastening means to an underside of a mattress;

sheet fastening means for releasbly grasping a bedsheet;

said fastening means including a clasping member having a bedsheet receiving slot and a slidable sheet grasping member including projection means for releasably sliding within said slot and for releasably grasping the bedsheet therebetween;

interconnecting means for interconnecting said anchoring means to said fastening means;

said projecting means includes a neck portion and a relatively enlarged button portion extending from said neck portion, said projecting means being sized and shaped to allow the bedsheet to be fitted over said button portion and to fit in said slot as said projecting means slidably moves in said slot, said neck portion being slidable within said slot and allowing the bedsheet to be accommodated between a bottom of said button and said clasping member;

said interconnecting means is elastic and facilitates said assembly accommodating different sized bedsheets;

said grasping member is a thin and flexible member and having locking projections which lockingly engage locking slots formed in said grasping member;

said locking projections project laterally from said neck portions for releasable engagement with said locking slots formed in portions of walls defining said bedsheet receiving slot;

said grasping member has retaining tabs extending therefrom;

said grasping member has split retaining legs;

said clasping member has recesses which slidably engage projections on said split retaining legs; and, said sheet grasping member is mounted for slidable and tiltable movement on said clasping member wherein said projection means can move between a position adjacent a top surface at said clasping member to a position adjacent a bottom surface of said clasping member to facilitate grasping and releasing of the bedsheet.

2. A sheet fastener comprising:

a clasping member having a sheet receiving slot; and, a slidable sheet grasping member including projecting means for releasably sliding within said slot and for releasably grasping the bedsheet therebetween; said projecting means includes a neck portion and a relatively enlarged button portion extending form said neck portion, said projecting means being formed to allow the bedsheet to be accommodated between a bottom of said button and said clasping member, to allow the bedsheet to fit over said button and within said slot, and to allow said grasping member being able to slidably and snugly engage the bedsheet resting on an opposite surface of said clasping member;

said grasping member is a thin and flexible member and has locking projection which releasably lockingly engage corresponding locking slots formed in said clasping member;

said locking projections project laterally from said neck portion, and said locking slots are formed in wall portions defining said sheet receiving slot;

said grasping member has retaining tabs extending therefrom;

said grasping member has split retaining legs;

said clasping member has recesses which slidably engage projections on said split retaining legs;

said clasping member has recesses which slidably engage projections on said split retaining legs; and, said sheet grasping member is mounted for slidable and tiltable movement on said clasping member wherein said projection means can move between a position adjacent a top surface at said clasping member to a position adjacent a bottom surface of said clasping member to facilitate grasping and releasing of the bedsheet.

* * * * *